US005226250A

United States Patent [19]

Ulmer et al.

[11] Patent Number: 5,226,250

[45] Date of Patent: Jul. 13, 1993

[54] PORTABLE, COLLAPSIBLE CRAFTWORK FRAME FOR TENSIONING TEXTILES

[76] Inventors: Larry Ulmer; Barbara Ulmer, both of P.O. Box 1330, Forsyth, Mo. 65653

[21] Appl. No.: 698,470

[22] Filed: May 10, 1991

[51] Int. Cl.[5] ..... D06C 3/08; B25H 1/18; A47B 3/08

[52] U.S. Cl. ..... 38/102.9; 38/102.91; 248/460; 269/901; 108/132

[58] Field of Search ..... 38/102, 102.1-102.5, 38/102.8, 102.9, 102.91, DIG. 1, DIG. 2; 108/6, 8, 10, 65, 90, 113, 115, 121, 150, 1, 32, 36, 91, 93, 127, 131, 132

[56] References Cited

U.S. PATENT DOCUMENTS

| | | | |
|---|---|---|---|
| 712,510 | 11/1902 | Dimick et al. | 38/102.1 |
| 1,056,966 | 3/1913 | Belding | 38/102.2 |
| 1,411,908 | 4/1922 | Cacici | 38/102.91 |
| 2,180,059 | 11/1939 | Kandle | 38/102.2 |
| 2,213,879 | 9/1940 | Evans | 38/102.3 |
| 2,760,299 | 8/1956 | Gable | 38/102.2 |
| 3,359,663 | 12/1967 | Black | 38/102.91 |
| 3,370,821 | 2/1968 | Mingis | 248/452 |
| 3,512,745 | 5/1970 | Gress | 248/457 X |
| 3,695,567 | 10/1972 | Weagle | 108/132 X |
| 3,762,080 | 10/1973 | Poole | 38/102.91 |
| 3,841,008 | 10/1974 | Cusick | 38/102.91 |
| 3,899,164 | 8/1975 | Newman | 248/451 X |
| 3,950,869 | 4/1976 | Samarin | 38/102.9 |
| 4,041,861 | 8/1977 | Alter | 38/102.91 X |
| 4,067,266 | 1/1978 | Lafargue | 108/113 X |
| 4,079,679 | 3/1978 | Bechtold | 108/132 |
| 4,194,312 | 3/1980 | Connors et al. | 38/102.91 X |
| 4,229,890 | 10/1980 | Dropinski | 38/102.91 X |
| 4,292,748 | 10/1981 | Miller | 38/102 |
| 4,297,953 | 11/1981 | Shy | 248/188.6 X |
| 4,378,646 | 4/1983 | Mazeika | 38/102.4 X |
| 4,430,815 | 2/1984 | Wulc | 38/102.91 |
| 4,471,543 | 9/1984 | Wolsey | 38/102.91 |
| 4,658,521 | 4/1987 | Thorpe | 38/102.6 |
| 4,658,522 | 4/1987 | Kramer | 38/102.91 |
| 4,726,556 | 2/1988 | Weir | 248/460 X |
| 4,909,491 | 3/1990 | Cheng | 269/901 X |
| 4,937,961 | 7/1990 | Gandy et al. | 38/102.91 X |
| 4,943,040 | 7/1990 | Finstad et al. | 108/6 X |
| 4,944,105 | 7/1990 | Schulle | 38/102 |
| 5,027,989 | 7/1991 | Nevius | 38/102.1 X |

FOREIGN PATENT DOCUMENTS

| | | | |
|---|---|---|---|
| 0957666 | 2/1950 | France | 108/6 |
| 1203412 | 10/1957 | France | 38/102.1 |

*Primary Examiner*—Clifford D. Crowder
*Assistant Examiner*—Ismael Izaguirre
*Attorney, Agent, or Firm*—Richard L. Marsh

[57] ABSTRACT

A portable craftwork device having a rectangular frame for supporting and tensioning sheet materials is provided. The frame has parallel ends and parallel sides, wherein each parallel end comprises a frame and plate, an upright leg, a leg end plate and a leg support. Each leg end plate is hingedly attached to a leg support and the upright leg is rotatably attached to the leg end plate. Each upright leg is further rigidly affixed to a foot. The rectangular frame may be rotated upon the frame leg end plate through an angle of up to 60° for working upon or displaying an artist's or craftspersons craftworks. The legs of the device may be collapsed inwardly and retained against the underside of the rectangular frame for storing of the portable device.

13 Claims, 3 Drawing Sheets

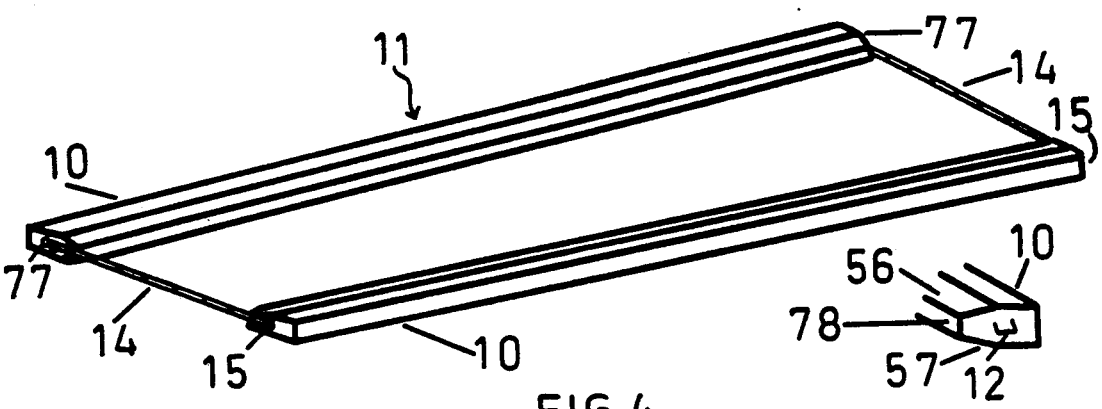
FIG. 4
FIG. 6
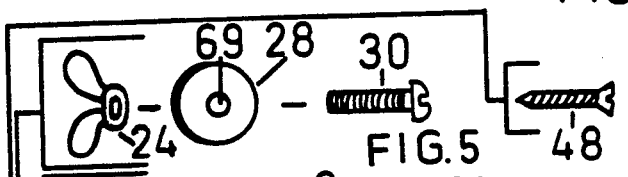
FIG. 5
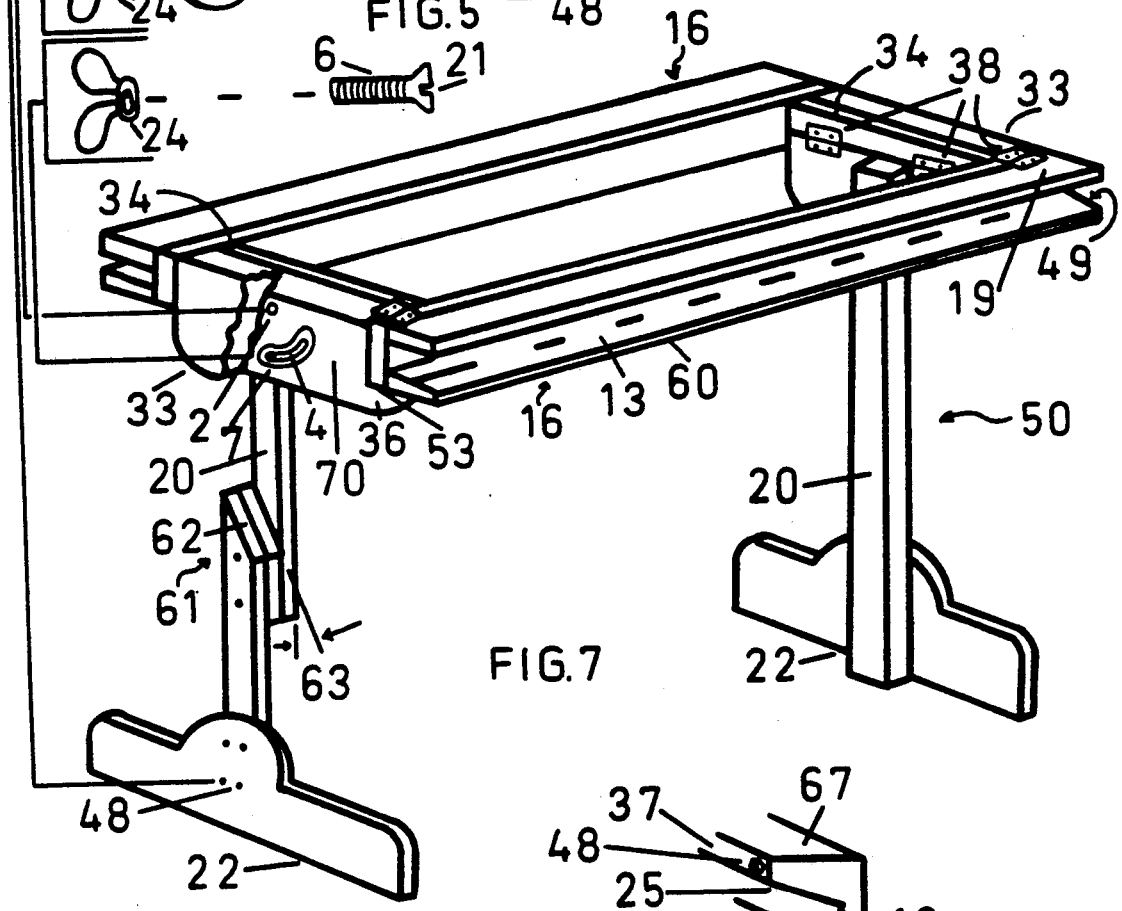
FIG. 7
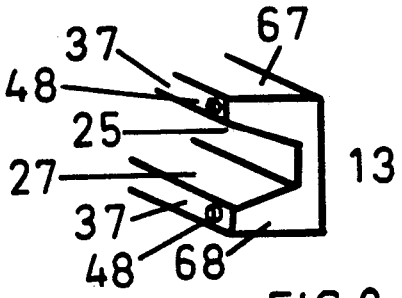
FIG. 8

PORTABLE, COLLAPSIBLE CRAFTWORK FRAME FOR TENSIONING TEXTILES

BACKGROUND OF THE INVENTION

1. Field of the Invention

This invention relates to a portable, collapsible device for tensioning and supporting sheet materials as used by artists, craftspersons and the like for the display of and working upon these sheet materials and specifically to quilting frames.

2. Description of the Related Art

The current art for tensioning and supporting textiles consists of two basic designs, the first of which is a rectangular frame having aprons of canvas or a similar fabric secured to opposing rails onto which the textiles are pinned, basted or sewn. While this device is effective, it usually requires considerable time to assemble and also requires either disassembly or large storage space upon completion of the current work. The other design is usually round or oval and consists of an outer ring pressed over an inner ring whereby the textile is trapped between the two rings. While this design is portable and easily stored, the available work area is insufficient. Larger versions with legs are available but they also require some disassembly for storage or transport. Furthermore, these devices of the prior art may also tend to cause the textile to be pinched, pierced, wrinkled or unevenly stretched in the tensioning process.

It is well known to provide a frame for supporting sheet materials such as fabric and to attach the sheet materials thereto by a piercing means such as nails, staples, serrations, pins or sewing. For instance, see U.S. Pat. Nos. 2,180,059 issued to Kandle, 2,213,879 to Evans, 3,841,008 to Cusick, 3,950,869 to Samarin, 4,229,890 to Dropinski, 4,471,543 to Wolsey, 4,658,521 to Thorpe and 4,944,105 to Schulle.

It is also well known to provide a frame for supporting sheet materials such as fabric and to clamp sheet materials between two mating surfaces. For instance, see U.S. Pat. Nos. 1,056,966 issued to Belding, 1,411,908 issued to Cacici, 2,213,879 issued to Evans, 2,760,299 issued to Gable, et al., and 4,658,522 issued to Kramer.

Further it is known to provide a frame for supporting sheet materials such as fabric and to hold sheet materials between two surfaces at least one of which is magnetic. For instance, see French patent 1,203,412 assigned to Brayhead (Ascot) Ltd.

Still further, it is known to provide a frame for supporting sheet materials such as fabric and to hold sheet materials onto such frame by folding the fabric over an edge and providing a clip means to hold the fabric thereto. For instance, see the aforementioned U.S. Pat. Nos. 3,950,869 to Samarin, 4,194,312 to Connors, et al., and 4,937,961 to Gandy, et al.

It is also known to provide a table surface which is folded upon itself, tilted about a central pivot, or adjusted in length and width for furniture or the display or working upon of materials. For instance, see U.S. Pat. No. 4,067,266 issued to Lafargue, or the aforementioned U.S. Pat. Nos. 4,229,890 issued to Dropinski, or 4,658,521 issued to Thorpe, or 4,943,040 issued to Finstad, et al, or 4,944,105 issued to Schulle.

It is further known to provide locking or wedging bars for retaining sheet materials within a groove. For instance, see U.S. Pat. Nos. 3,359,663 issued to Black, 3,762,080 issued to Poole, 4,041,861 issued to Alter, and 4,430,815 issued to Wulc.

It is further known to provide means for tensioning or retaining sheet materials by using a spring loaded piercing element or an advancing mechanism such as a screw, pawl or roller. For instance, see the aforementioned U.S. Pat. Nos. 2,180,059 issued to Kandle, 3,359,663 issued to Black, 3,762,080 issued to Poole, 4,041,861 issued to Alter, 4,430,815 issued to Wulc and 4,937,961 issued to Gandy, et al.

It is known in the art to stretch sheet materials upon a frame by utilizing a holding bar within or with a retaining clip and moving a portion of the holding bar to a tensioned position with a second retaining clip. For instance, see the aforementioned U.S. Pat. Nos. 3,950,869 to Samarin or 4,937,961 to Gandy, et al.

Finally, it is known to stretch sheet materials by bending a frame relative to a work surface in order to permanently mount sheet materials upon the frame. For instance, see U.S. Pat. No. 4,471,543 issued to Wolsey.

It is apparent from a review of the art cited above that a portable, collapsible, free standing device for tensioning and supporting sheet materials has not been produced. It is also apparent that the mechanisms for tensioning the fabric require many parts or are somewhat cumbersome to utilize.

SUMMARY OF THE INVENTION

Therefore, it is an object of this invention to provide a portable, collapsible, free standing rectangular frame means for supporting and tensioning sheet materials comprising parallel end means and parallel side means wherein at least one of the parallel side means has sheet retaining means disposed therein.

It is another object of this invention to provide a sheet retaining means comprising an independent rail means adapted to be releasably received in a slot in a parallel side means of a portable rectangular frame means.

It is another object of this invention to provide an independent rail means which comprises a biasing means attached to at least one end thereof for biasing said independent rail means into said slot in a parallel side means of a portable rectangular frame means.

It is an object of this invention to provide at least a portion of one of said parallel side means which is rotatably hingedly attached to a portion of said end means and where said biasing means of said independent rail means cooperates to comprise an over center locking arrangement for a portable rectangular frame means.

It is an object of this invention to provide means to rapidly re-tension said sheet material on a portable rectangular frame means.

It is an object of this invention to provide at least a portion of one of said end means which is hingedly attached to at least one leg support means having a locking means thereon for receiving a temporary locking means for releasably attaching said leg support means to said end means, said leg support means which is rigidly affixed to at least one foot means whereby said portable frame means becomes a free standing surface for working upon or the display of artist's or craftspersons works and which can be readily collapsed and stored with a sheet material thereupon.

BRIEF DESCRIPTION OF THE DRAWINGS

FIG. 4 is a perspective view of the sheet retaining means showing biasing means attached at each end.

FIG. 5 is a view of the various hardware used in assembling the frame of the instant invention.

FIG. 6 is a fragmentary view of one end of independent side rails showing means of attaching the biasing means thereto.

FIG. 7 is a partial fragmentary perspective view of the frame of the instant invention showing the attachment of the leg means to the leg support means.

FIG. 8 is a partial end view of one end of the parallel side means showing the slot means therein.

DESCRIPTION OF THE PREFERRED EMBODIMENTS

Figure 1:
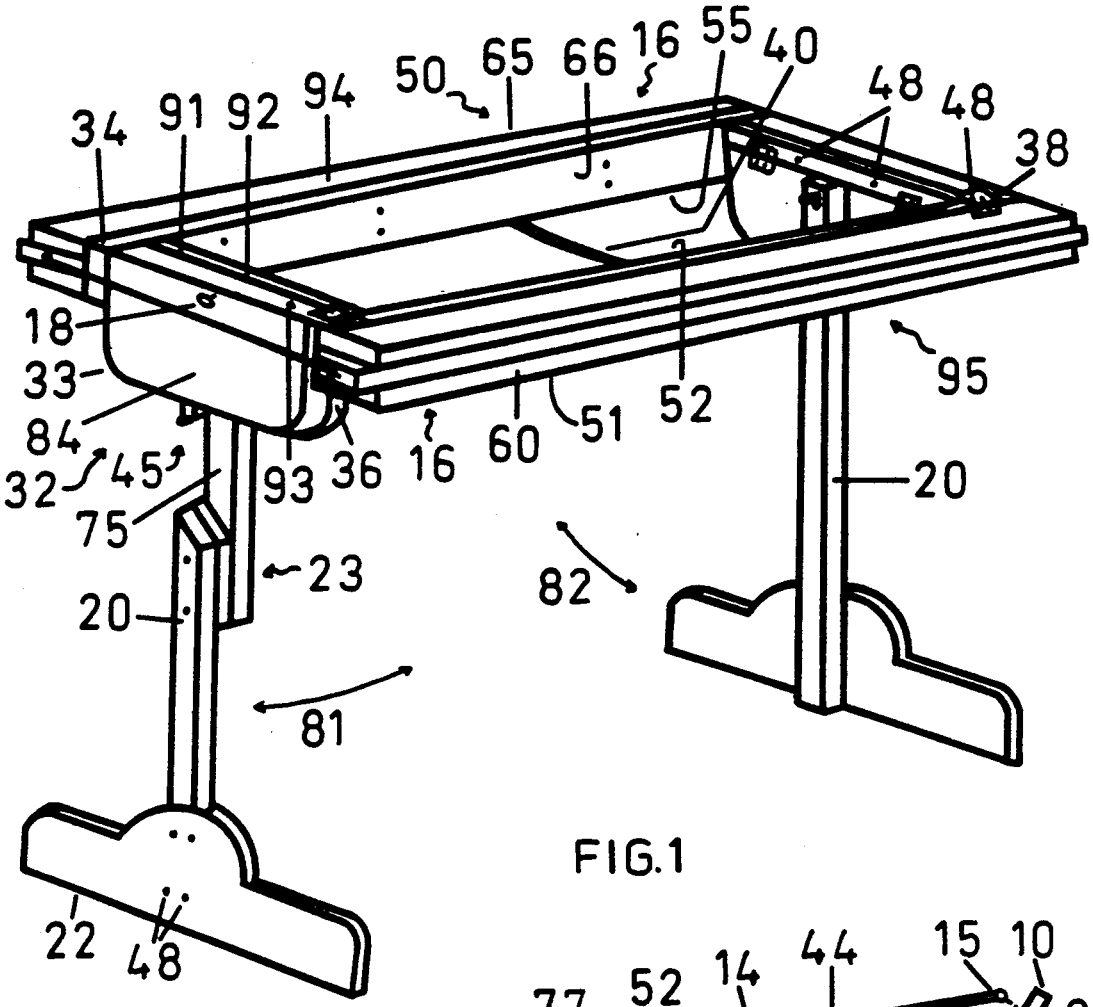
FIG. 1 is a perspective view of the portable frame means of the invention fully assembled and in a free standing position.

While the various features of this invention are hereinafter illustrated and described as providing a portable, free standing, collapsible frame for the support and tensioning of sheet materials for the display and working upon of craftspersons works, it is to be understood that the various features of this invention can be utilized singly or in any combination thereof to provide a frame for other arrangements as desired.

Therefore, this invention is not to be limited to only the embodiments illustrated in the drawings, because the drawings are merely utilized to illustrate one of the wide variety of uses of this invention.

Referring now to FIG. 1 and FIG. 7, a portable frame means generally indicated by the numeral 50 for supporting and tensioning sheet material 44 comprises rectangular frame means 95 having parallel end means 32 and parallel side means 16. Parallel end means 32 further comprise a frame end plate 33 and a leg support means 34 wherein at least a portion of said leg support means 34 is hingedly attached to leg end plate means 36. Each leg end plate means 36 is attached to at least one upright leg means 20 and is adapted to be releasably affixed thereto by locking member 45, such as a common sash lock, comprised of a locking catch 47 and a locking means 46 shown separately in FIG. 8. The leg end plate means 36 has curved slot means 4 therein for receiving a temporary locking means 29, comprising bolt 6, washer 28, and wing nut 24, of FIG. 5 for rotatably attaching said leg end plate means 36 to said upright leg means 20. The upright leg means 20 is rigidly affixed to at least one foot means 22 by screws members 48, whereby portable frame means 50 becomes a free standing surface for working upon or the display of artist's or craftspersons works.

Figure 2:
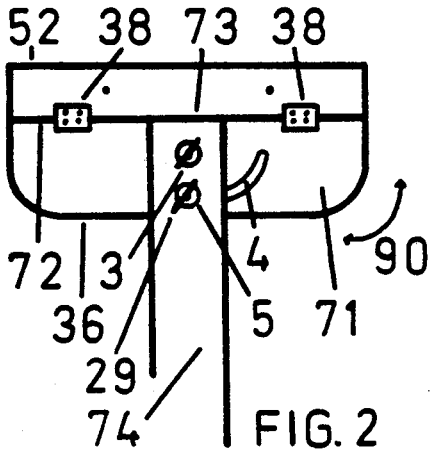
FIG. 2 is a view of the inside of one end of the frame of FIG. 1, with the parallel side means removed therefrom showing how the leg is mounted.
Figure 9:
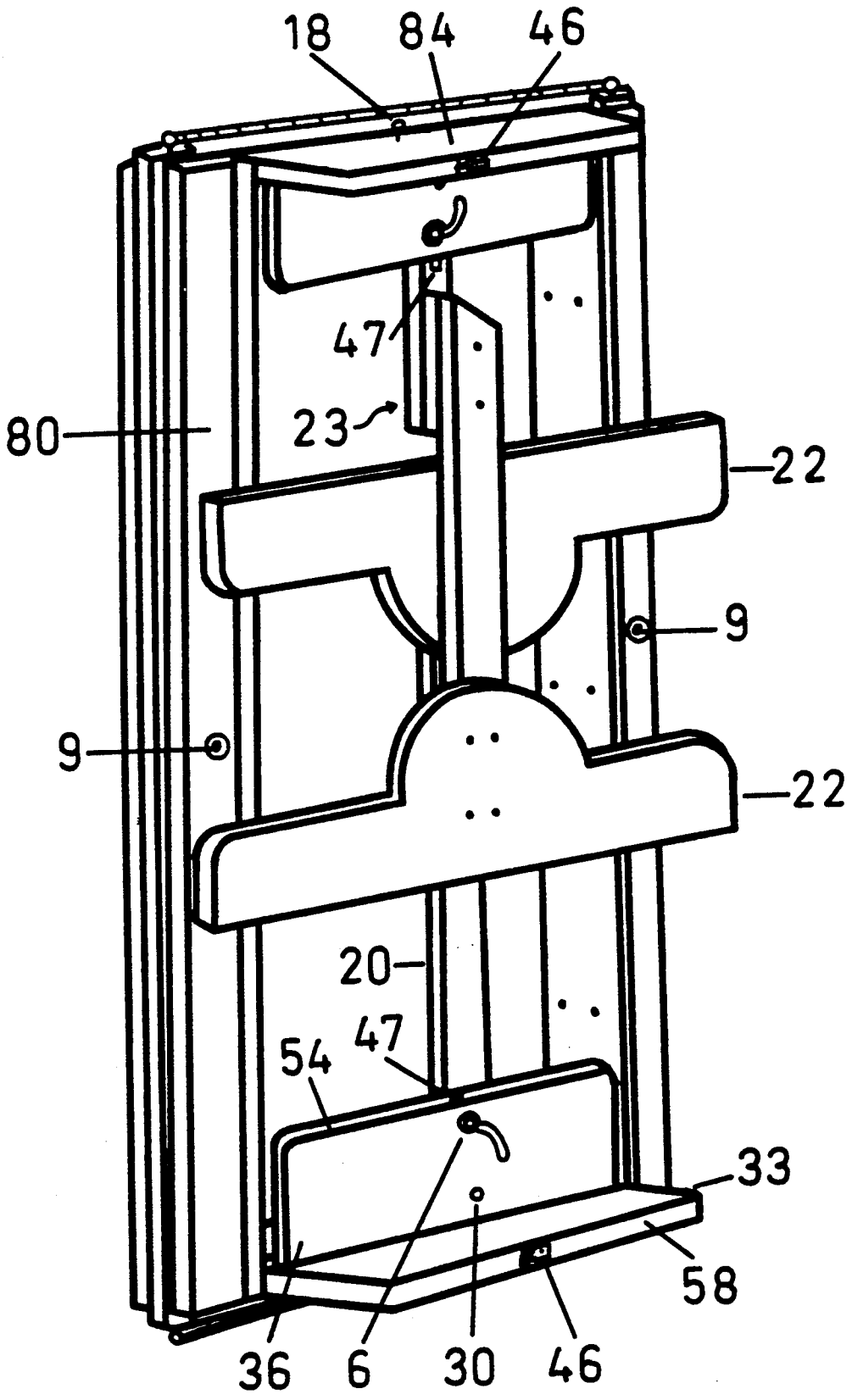
FIG. 9 is a perspective view of the bottom of the frame means in a collapsed state ready for storage.

Referring now to FIG. 2, FIG. 7 and FIG. 9, leg end plate means 36 is hingedly attached to leg support means 34 by hinge means 38 which is affixed to leg support means 34 and leg end plate means 36 by screw members 48. Leg end plate means 36 has hole means 2 disposed therein and further has curved slot means 4 disposed therein spaced from hole means 2, wherein said hole means 2 and curved slot means 4 extend through leg end plate means 36 from the inside 70 thereof to the other side 71 thereof. Leg end plate means 36 further has a recess 7 extending along curved slot means 4 to allow space for head 21 and washer 28 of bolt 6 to move without damaging frame end plate 33 during the tilting of rectangular frame means 95 of portable frame means 50. Upright leg means 20 has first hole means 3, covered by washer 28 and wing nut 24 in FIG. 2, disposed therein and further has second hole means 5, covered by washer 28 and wing nut 24 in FIG. 2, disposed therein. First hole means 3 and second hole means 5 extend through upright leg means 20 from the outside 75 thereof to the inside 74 thereof. Pivot bolt 30 is disposed through hole means 2 of leg end plate means 36 and through first hole means 3 of upright leg means 20 and is retained therein by washer 28 and wing nut 24 wherein pivot bolt 30 provides a pivot axis for rotatably affixing leg end plate means 36 of rectangular frame means 95 to said upright leg means 20. In a like manner, bolt 6 is disposed through a portion of curved slot means 4 of leg end plate means 36 and through second hole means 5 of upright leg means 20 and is releasably retained within said second hole means 5 and curved slot means 4 by washer 28 and wing nut 24. In this manner, rectangular frame means 95 may be tilted about the pivot axis, as shown by the double ended direction arrow 90, by releasing temporary locking means 29, tilting the rectangular frame means 95 to a certain angle of rotation. Rectangular frame means 95 may then be secured at said certain angle by merely securing the wing nut 24 against washer 28 upon temporary locking means 29 thereby clamping leg end plate means 36 against upright leg means 20. Curved slot means 4 in leg end plate means 36 is of sufficient length to provide for said certain angle of rotation of rectangular frame means 95 to vary from about 0° to about 60° from the horizontal.

It can be readily seen by one skilled in the art that leg end plate means 36 being hingedly attached to leg support means 34 by hinge means 38 is free to rotate or fold inwardly and upwardly toward the underside 80 of portable frame means 50 as shown by the direction arrows 81 and 82 in FIG. 1. As best observed in FIG. 9, one upright leg means 20 is adapted to fold substantially parallel with the underside 80 of portable frame means 50 while the other upright leg means 20 is provided with offset means 23 such that the foot means 22 of the one upright leg means 20 nests within the offset means 23 of the other upright leg means 20 to provide for convenient storage of portable frame means 50. When both upright leg means 20 are rotated upwardly and inwardly to the underside 80 of portable frame means 50, securing means 40, shown in FIG. 1, is looped around both upright leg means 20 and secured to a releasable means 9 such as a snap, on the underside 51 of rotatable side means 60.

Offset means 23 further has surface 62 disposed at an angle 63 of approximately 60° from the vertical as shown in FIG. 7 providing stop means 61 for the underside 58 of frame end plate 33. Thus, stop means 61 provides support for rectangular frame means 95 when rotated downwardly at the maximum angle of 60° of said certain angle from the horizontal to prevent damage to curved slot means 4.

As best seen in FIG. 9, locking catch 47, such as the striking plate of a common sash lock, is attached to the bottom 54 of leg end plate means 36 such as by screw members 48 (not shown) and locking means 46 is similarly attached to the underside 58 of frame end plate 33, for releasably attaching said leg end plate means 36 of upright leg means 20 to frame end plate 33 of parallel end means 32 to provide means to erect said portable frame means 50 and retain same in an upright position thereof. It is readily appreciated here that the cam surface of the common sash lock used in locking means 46 with locking catch 47 draws upright leg means 20 tightly against frame end plate 33 thereby maintaining portable frame means 50 in a rigid upright position.

Figure 3:
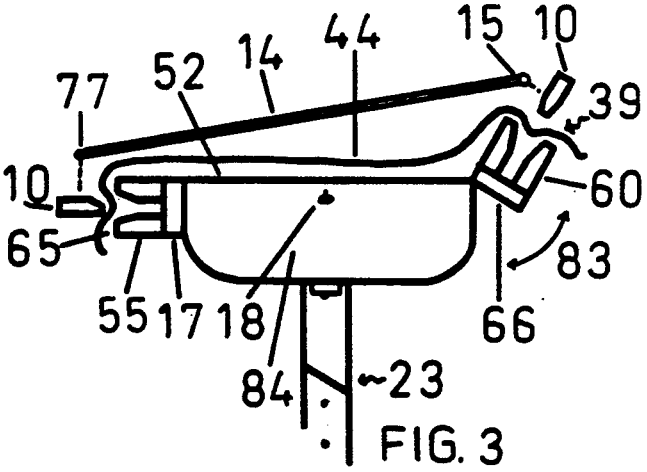
FIG. 3 is an end view of the frame in FIG. 1 showing sheet materials disposed thereon with independent side rails in a retracted position for purposes of clarity.

Referring now to FIG. 7 and FIG. 8, parallel side means 16 has sheet engaging means generally indicated by reference numeral 39, providing means to retain sheet material 44 in temporary relation to rectangular frame means 95. In this preferred embodiment, sheet engaging means 39 comprises slot means 13 provided in parallel side means 16 extending from one end 49 to the other end 53 thereof and independent rail means 10 of sheet retaining means 11. Slot means 13 may be provided in parallel side means 16 such as by forming a slot in a solid piece of material, such as wood, as shown in FIG. 8 or may be formed by affixing three pieces of material, such as wood, together with screw members 48 as shown in FIG. 3. Slot means 13 preferably has opposed converging sides 25 and 27 each of which may be disposed at any angle within slot means 13. Slot means 13 is adapted to receive independent rail means 10 with sheet material 44 therebetween.

In this preferred embodiment, one of said parallel side means 16 comprises rotatable side means 60 which has at least a portion 19 rotatably hingedly attached to frame end plate 33 with hinge means 38 such that rotatable side means 60 may be rotated upwardly as shown by arrow 83 in FIG. 3, to receive sheet material 44 and independent rail means 10 therein in order to support and tension sheet material 44 as will hereinafter be described. Sheet retaining means, generally indicated by numeral 11 in FIG. 4, comprises at least one independent rail means 10 and at least one biasing means 14 attached to at least one end 15 thereof with attachment means 12 such as a staple, as shown in FIG. 6, for biasing one independent rail means 10 toward another independent rail means 10.

When it is desired to mount sheet material 44 upon rectangular frame means 95 for the display thereof or for working upon the same, sheet material 44 is laid across the working surface 52 of rectangular frame means 95 draping over both parallel side means 16 as can be fully appreciated by referring to FIG. 3. One independent rail means 10 of sheet retaining means 11 is then placed against sheet material 44 adjacent fixed parallel side means 65. Rotatable side means 60 is then rotated upwardly in a direction of arrow 83 to an angle from the horizontal not to exceed 90°, and the other independent rail means 10 of sheet retaining means 11 is placed against the sheet material 44 adjacent rotatable side means 60. In this preferred embodiment, independent rail means 10 is adapted to fit within slot means 13 of parallel side means 16. Biasing means 14, such as a common door spring, of sheet retaining means 11 is of sufficiently short length to provide a biasing force between independent rail means 10 when same are disposed in slot means 13 of parallel side means 16 of fully assembled portable frame means 50 of FIG. 1. In FIG. 3, the ends 15 and 77 of biasing means 14 have been removed from independent rail means 10 presenting an exploded view of sheet retaining means 11 for purposes of clarity. It is fully appreciated that in the mounting of sheet material 44, sheet retaining means 11 would be fully assembled as shown in FIG. 4.

Independent side rail means 10, when disposed in slot means 13 of rotatable side means 60, may provide an initial tension to sheet material 44 by carrying into slot means 13 a portion of sheet material 44 and retaining same therein with biasing means 14 before rotatable side means 60 is rotated into a final position. When rotatable side means 60 is then rotated downwardly, said biasing means 14 of said independent rail means 10 and rotatable side means 60 corroborate to comprise an over center locking and tensioning arrangement for said rectangular frame means 95, retaining sheet material 44 within slot means 13 of parallel side means 16 with a final tension thereof.

It is fully appreciated here, that the tension of sheet material 44 may readily be changed by merely rotating rotatable side means 60 upwardly approximately 90°, removing the one independent rail means 10 therefrom, repositioning sheet material 44 to a new position thereof and returning independent rail means 10 and rotatable side means 60 to the original downward and locked position. In a similar manner, sheet material 44 may be repositioned for work upon another portion thereof by rotating rotatable side means 60 upwardly, removing sheet retaining means 11, repositioning sheet material 44 and replacing sheet retaining means 11 as hereinbefore described and finally applying tension to sheet material 44 by rotating rotatable side means 60 to the final tensioning position thereof.

Independent rail means 10 may have opposed converging sides 56 and 57 disposed at an angle equal to the angle of converging sides 25 and 27 of slot means 13. Preferably the angles of converging sides 56 and 57 are different from each other and also different from the angle between converging sides 25 and 27 of slot means 13 to prevent independent rail means from being locked within slot means 13. Independent rail means 10 is preferably of substantially the same length as parallel side means 16 as measured from one end 49 to the other end 53 thereof but of course independent rail means 10 could be of greater length. Independent rail means 10 are preferably made of wood but not limited to this material.

Securing means 40 may then be secured to releasable means 9 on the underside 51 of rotatable side means 60 preventing accidental loss of tension to sheet material 44. Securing means 40 is of sufficient length to loop around both leg means when in a folded position for storage. Securing means 40 is preferably a narrow strip of braided nylon approximately one inch wide.

Portable frame means 50 may be readily stored on a simple hook on a wall by placing the folded portable frame means 50 of FIG. 9 upon said hook utilizing storage eyelet 18 which is disposed in the side 84 of frame end plate 33. Storage eyelet 18 is preferably a common hardware screw eyelet having an eye diameter of approximately one-half inch.

Referring now to FIG. 1 and FIG. 7, a method of making a portable frame means for supporting and tensioning sheet material 44 generally indicated by the numeral 50 is now described. Rectangular frame means 95 is constructed of parallel side means 16 and parallel end means 32 wherein one parallel side means 65 is fixedly attached to parallel end means 32 with screw members 48 which extend from the edge 37 of fixed parallel side means 65 as shown in FIG. 8, into the ends (not shown) of frame end plate 33 and leg support means 34. Parallel end means 32 and fixed parallel side means 65 are aligned, with the top surface 91 of parallel end means 32 being flush and square with the top 94 of fixed parallel side means 65. Rectangular frame means 95 has parallel end means 32 formed in three pieces, a frame end plate 33, a leg end plate means 36 and a leg support means 34. Leg support means 34 is permanently attached to frame end plate 33 by inserting screw members 48 through leg support means 34 into frame end plate 33. The top surface 92 of leg support means 34 is flush with the top surface 93 of frame end plate 33 and therefore flush with the top surface 94 of fixed parallel side means 65 as aforementioned. The top surfaces 92, 93 and 94 provide a flat surface comprising the working surface 52 of rectangular frame means 95.

The other of said parallel side means 16 comprises rotatable side means 60 which has at least a portion 19 attached to frame end plate 33 with hinge means 38 such that rotatable side means 60 may be rotated upwardly and downwardly as shown by arrow 83 in FIG. 3. Hinge means 38 are attached to portion 19 and frame end plate 33 by screw members 48.

Referring to FIG. 7 and FIG. 8, parallel side means 16 have a slot means 13 formed therein extending from one end 49 to the other end 53 thereof. Slot means 13 may be formed in parallel side means 16 in any manner known in the art, such as by cutting a slot in a solid piece of material, such as wood as shown in FIG. 8, or may be formed by affixing three pieces of material, such as wood, together as shown in FIG. 3 or FIG. 7. Slot means 13 preferably has opposed converging sides 25 and 27 formed therein, each of which may be disposed at any angle within slot means 13. When parallel side means 16 is formed of three pieces comprising projecting sides 67 and 68 and base plate 17, projecting sides 67 and 68 are attached to base plate 17 by screw members 48 extending from the backside 66 of base plate 17 as shown in FIG. 3, through base plate 17 and into projecting sides 67 and 68 and may also extend from edge 37 of projecting sides 67 and 68 respectively into base plate 17. Similarly, projecting sides 67 and 68 may have a suitable adhesive means placed between the edges thereof joining with base plate 17.

Referring now to FIG. 2, FIG. 7 and FIG. 9, leg end plate means 36 is hingedly attached to leg support means 34 by hinge means 38. Hinge means 38 are affixed to leg support means 34 and leg end plate means 36 by screw members 48. Leg end plate means 36 has hole means 2 drilled therethrough and further has curved slot means 4 milled or routed therein spaced from hole means 2. Hole means 2 and first hole means 3 are aligned one with the other such that upper surface 72 of leg end plate means 36 is aligned with the upper end 73 of upright leg means 20. Similarly, hole means 5 in upright leg means 20 is aligned with curved slot means 4 of leg end plate means 36. Hole means 2 and curved slot means 4 extend through leg end plate means 36 from the inside 70 thereof to the other side 71 thereof. Leg end plate means 36 further has a recess 7 milled or routed therein extending along curved slot means 4 to allow space for head 21 and washer 28 of bolt 6.

Upright leg means 20 has a first hole means 3 drilled therein and further has a second hole means 5 drilled therein spaced from first hole means 3. First hole means 3 and second hole means 5 extend through upright leg means 20 from the outside 75 thereof to the inside 74 thereof. One upright leg means 20 is provided with offset means 23 formed therein wherein the amount of offset is approximately equal to the thickness of foot means 22 and upright leg means 20 such that foot means 22 nests within the offset means 23 when portable frame means 50 is in the collapsed state thereof. Offset means 23 has surface 62 formed thereon at an angle 63 of approximately 60° from the vertical as shown in FIG. 7 providing stop means 61 for underside 58 of frame end plate 33.

Upright leg means 20 has foot means 22 attached at the end opposite upper end 73 thereof with screw members 48 in a manner such that foot means 22 provides a secure base for portable frame means 50 in the upright position as shown in FIG. 1 and FIG. 7. Upright leg means 20 is attached to leg end plate means 36 with pivot bolt 30 extending through hole means 2 of leg end plate means 36 and through first hole means 3 of upright leg means 20 and is rotatably attached thereto with washer 28 and wing nut 24. Head 31 of pivot bolt 30 is recessed into leg end plate means 36 in a manner well known in the art. Similarly, bolt 6 is placed in hole 69 in washer 28, through curved slot means 4, and through second hole means 5 in upright leg means 20. Bolt 6 is releasably affixed thereto with washer 28 and wing nut 24 thereby producing temporary locking means 29. When wing nut 24 of bolt 6 is loosened, leg end plate means 36 is free to rotate upon upright leg means 20 as bolt 6 slides within curved slot 4. As rectangular frame means 95 is firmly attached to leg end plate means 36 as hereinbefore described, rectangular frame means 95 is free to rotate through an angle of approximately 60° from the horizontal. Securing means 40 is preferably attached to the underside 55 of fixed parallel side means 65 with another releasable means 9.

As best seen in FIG. 9, locking catch 47, such as the striking plate of a common sash lock, is attached to the bottom 54 of leg end plate means 36 by screw members 48. Similarly, locking means 46 is attached to the underside 58 of frame end plate 33. Locking means 46 is rotated into engagement with locking catch 47 on upright leg means 20 to provide means to erect said portable frame means 50 and retain same in an upright position thereof. In a like manner, locking means 46 may be rotated out of engagement with locking catch 47 for releasing upright leg means 20 from frame end plate 33 providing means to collapse portable frame means 50 as shown in FIG. 9. In this preferred embodiment the common sash lock with a cam surface has proven to be very effective in erecting portable frame means 50 and sufficiently strong to maintain same in an upright position while providing a rapid means for collapsing same for storage. It is readily appreciated here that the cam surface of the common sash lock used in locking member 46 with locking catch 47 draws upright leg means 20 tightly against frame end plate 33 thereby maintaining portable frame means 50 in a rigid upright position.

Sheet retaining means, generally indicated by numeral 11 in FIG. 4, comprise independent rail means 10 and biasing means 14. Independent rail means 10 is preferably formed of a suitable material, such as wood, for engaging sheet material 44 and has at least one pair of converging sides 56 and 57 formed on one surface 78 thereof by cutting same at an angle as is well known in the art. Independent rail means 10 is generally longer than slot means 13 of parallel side means 16 to allow for the attachment and operation of biasing means 14. Biasing means 14 is preferably a common door spring and is attached to the one end 15 of independent rail means 10 with attachment means 12 such as a staple, as shown in FIG. 6.

Biasing means 14 is formed from a common door spring. In FIG. 3, the ends 15 and 77 of biasing means 14 have been removed from independent rail means 10 presenting an exploded view of sheet retaining means 11 for purposes of clarity. It is fully appreciated that in the mounting of sheet material 44, sheet retaining means 11 would be fully assembled as shown in FIG. 4.

Securing means 40 is a narrow strip of braided nylon approximately one inch wide with one part of a common snap affixed at least at one end thereof.

While the forms and methods of this invention now preferred have been illustrated and described as required by the Patent Statute, it is to be understood that other forms and methods can be utilized and still fall within the scope of the appended claims.

We claim:

1. A portable craftwork device comprising a rectangular frame having means for supporting and tensioning sheet materials, said frame having parallel ends and parallel sides wherein each end comprises a frame end plate, an upright leg, a leg end plate and a leg support, said leg end plate is hingedly attached to said leg support, said upright leg is rotatably attached to said leg end plate and said upright leg is further rigidly affixed to a foot, said leg end plate has a curved slot therein for receiving a temporary locking means for angularly affixing said leg end plate with respect to said upright leg whereby said portable device forms a free standing frame for working upon or displaying an artist's of craftpersons craftworks.

2. The portable device in claim 1 wherein at least one of said parallel sides is rotatably attached to said parallel ends.

3. The portable device in claim 2 wherein said one of said parallel sides is rotatably hingedly attached to said ends.

4. The portable device in claim 1 wherein said means for supporting and tensioning sheet materials is on said parallel sides and comprises an independent rail and biasing means on each side such that said rails are biased one toward the other and wherein said rails support and retains said sheet material between said rails and said parallel sides whereby said rails affix said sheet material to said parallel sides in temporary relation thereto.

5. The portable device in claim 4 wherein said parallel sides and said biasing means of said independent rails corroborate to form an over center locking arrangement for sheet materials on said frame.

6. The portable device in claim 1 wherein said leg end plate has locking means thereon for releasably attaching said leg end plate to said frame end plate.

7. The portable device of claim 1 wherein said upright legs, said feet and said leg end plates fold upwardly and inwardly toward an underside of said device in a storage position thereof.

8. The portable device in claim 7 wherein one of said upright legs has an offset formed therein for accommodating the other upright leg within said offset in a nested manner.

9. The portable device of claim 8 wherein said parallel sides have securing means on an underside thereof for retaining said upright legs, said feet and said leg end plates against said underside of said device in said storage position thereof.

10. The portable device of claim 8 wherein said offset has stop means on a surface thereof.

11. A portable craftwork device comprising a rectangular frame having means for supporting and tensioning sheet materials, said frame having parallel ends and parallel sides wherein each end comprises a frame end plate, an upright leg, a leg end plate and a leg support, said leg end plate is hingedly attached to said leg support, said upright leg is rotatably attached to said leg end plate and said upright leg is further rigidly affixed to a foot whereby said portable device forms a free standing frame for working upon or displaying an artist's of craftsperson's craftworks and wherein said means for supporting and tensioning sheet materials is on at least one of said parallel sides and comprises a slot disposed therein, and said sheet retaining means comprises an independent rail releasably received in said slot.

12. The portable device in claim 11 wherein said independent rail further comprises biasing means attached to at least one end thereof for biasing said independent rail into said slot.

13. A method of making a portable craftwork frame having means for supporting and tensioning sheet materials comprising the steps of forming parallel ends, each made made up of frame end plates, leg end plates, upright legs and leg supports, rotatably attaching the upright legs to said leg end plates, providing feet, rigidly affixing said upright legs to said feet, hingedly attaching said leg end plates to said leg supports, providing connecting means on said leg end plates and said upright legs for mutual connection, said leg end plates being releasably locked to said frame end plates, forming parallel sides with slots therein, affixing said parallel sides to said frame end plates, at least one of said parallel sides being rotatably attached to said end plates, providing sheet retaining means on the sides and independent rails co-acting with said retaining means providing biasing means, attaching the biasing means to at least one end of each said independent rails, providing securing means releasably attached to said parallel sides whereby said portable frame forms a free standing device for working upon or displaying artist's or craftspersons craftworks.

* * * * *